US007033249B2

(12) United States Patent
Spalteholz et al.

(10) Patent No.: US 7,033,249 B2
(45) Date of Patent: Apr. 25, 2006

(54) DRY ICE BLASTING CLEANING APPARATUS

(75) Inventors: Bernhard Alexander Spalteholz, Surrey (CA); Geoffrey Paul Nielsen, Vancouver (CA)

(73) Assignee: British Columbia Hydro and Power Authority, Vancouver (CA)

( * ) Notice: Subject to any disclaimer, the term of this patent is extended or adjusted under 35 U.S.C. 154(b) by 0 days.

(21) Appl. No.: 11/128,800

(22) Filed: May 13, 2005

(65) Prior Publication Data

US 2005/0272347 A1 Dec. 8, 2005

(30) Foreign Application Priority Data

May 14, 2004 (CA) ..... 2467316

(51) Int. Cl.
*B24B 49/00* (2006.01)

(52) U.S. Cl. ..... 451/7; 451/40; 451/53; 451/75; 451/90; 134/108

(58) Field of Classification Search ..... 451/38, 451/39, 40, 7, 53, 75, 90, 102; 134/6, 13, 134/105, 108, 198, 172
See application file for complete search history.

(56) References Cited

U.S. PATENT DOCUMENTS

| | | | | |
|---|---|---|---|---|
| 5,009,240 | A * | 4/1991 | Levi | 134/7 |
| 5,405,283 | A * | 4/1995 | Goenka | 451/39 |
| 5,733,174 | A * | 3/1998 | Bingham et al. | 451/39 |
| 5,766,368 | A * | 6/1998 | Bowers | 134/6 |
| 5,846,338 | A * | 12/1998 | Bonora et al. | 134/11 |
| 5,928,434 | A * | 7/1999 | Goenka | 134/2 |
| 5,976,264 | A * | 11/1999 | McCullough et al. | 134/2 |
| 6,120,357 | A * | 9/2000 | Jackson et al. | 451/53 |
| 6,565,920 | B1 * | 5/2003 | Endisch | 427/240 |
| 6,641,675 | B1 * | 11/2003 | Dryer et al. | 134/1 |
| 6,695,686 | B1 * | 2/2004 | Frohlich et al. | 451/102 |
| 6,851,148 | B1 * | 2/2005 | Preston et al. | 8/158 |
| 6,863,594 | B1 * | 3/2005 | Preising | 451/39 |
| 6,899,110 | B1 * | 5/2005 | Yoshida et al. | 134/107 |

* cited by examiner

*Primary Examiner*—Eileen P. Morgan
(74) *Attorney, Agent, or Firm*—Jeffer Mangels Butler & Marmaro, LLP

(57) ABSTRACT

The invention is an apparatus used for cleaning equipment including extremely high voltage energized electrical equipment using a dry ice blasting stream as the cleaning agent. The apparatus comprises a cleaning wand and a heating mechanism for impeding the formation of condensation and/or frost on the outer surface of the wand, thereby enabling the wand to operate for prolonged periods of time.

17 Claims, 3 Drawing Sheets

DRY ICE BLASTING CLEANING APPARATUS

FIELD OF THE INVENTION

This invention relates generally to a dry ice blasting apparatus for cleaning equipment and parts, such as energized high voltage (EHV) electrical equipment.

BACKGROUND OF THE INVENTION

Cleaning by dry ice blasting is a relatively new process that has quickly become a popular alternative to traditional cleaning methods such as steam cleaning, sandblasting, and cleaning with solvents. Dry ice blasting involves the discharge of a blasting stream substantially comprising dry ice ($CO_2$) particles and a carrier stream of gas under pressure. The gas is usually air, although other gases such as nitrogen, carbon dioxide, or argon can also be used.

Dry ice blasting can be used to clean equipment and parts in many different industries, such as automotive, aerospace, food processing, marine and electrical industries. Dry ice blasting is particularly desirable for cleaning electrical equipment in the utilities industry, as it can provide a moistureless blasting stream, which is particularly advantageous for cleaning equipment that is sensitive to moisture. Therefore, cleaning by dry ice blasting facilitates preventative maintenance planning and avoids the potentially considerable downtimes required to clean equipment by traditional methods. Various electrical equipment can be cleaned by dry ice blasting, including pad-mounted switchgear, generator windings, transformer bushings, and substation and line insulators. The dry ice blasting stream instantly freezes contaminants on the equipment, causing the bond between the contaminants and the substrate surface of the equipment to break. The rapid velocity of the blasting stream separates the contaminants from the equipment and the dry ice quickly sublimates into a gas. As a result, there is no drying period as required in pressure washing or steam cleaning, nor is there any requirement to dispose of toxic material as required in solvent-based cleaning. Power interruptions to customers can therefore be minimized, system reliability can be improved, and the dangers associated with switching can be avoided.

Use of dry ice blasting to clean energized electrical equipment has been previously achieved. However, known dry ice blasting cleaning devices are limited to cleaning equipment energized at relatively low voltages of usually under about 50 kV, such as pad-mounted switchgear. The electric field of such low voltage equipment typically requires an operator and his cleaning device to stand at least three feet away to avoid injury, unless the cleaning device and operator are electrically insulated. Examples of such devices include electrically insulated cleaning wands that discharge $CO_2$ through a tubular section that is thermally insulated with a polyurethane foam, thereby enabling the wand to be operated to up to around ten minutes before condensation and/or frost collects on the outer surface of the wand and degrades the electrically insulating properties of the wand beyond an acceptable safety level. Therefore, the operator must complete his cleaning task before this period, or periodically stop cleaning to allow enough time for the wand to sufficiently thaw. As such thaw periods add considerable delay to the cleaning process, operators can use multiple cleaning wands in staggered time intervals to minimize the delay.

While some low voltage electrical devices are relatively small and can be cleaned in under ten minutes, EHV electrical equipment energized to up to 500 kV are typically larger and thus take longer to clean. Furthermore, energized EHV equipment produce much larger electric fields which require a farther safe operating distance than low voltage equipment. Known dry ice blasting cleaning devices are not built with lengths or operating periods that are suitable to safely clean such energized EHV equipment.

SUMMARY OF THE INVENTION

One general object of the invention is to provide an improved dry ice blasting cleaning apparatus. One particular objective is to provide a dry ice blasting cleaning apparatus that can operate for prolonged periods of time and without thawing periods. Another particular objective is to provide a dry ice blasting cleaning apparatus that is particularly suitable to clean energized electrical equipment such as EHV equipment.

According to one aspect of the invention, there is provided a dry ice blasting apparatus for cleaning electrical equipment, that comprises a cleaning wand and a heating mechanism for impeding the formation of condensation and/or frost on the outer surface of the wand, thereby enabling the wand to operate for prolonged periods of time. The cleaning wand comprises an elongated body having a handle portion at a proximal end of the body, a dry ice blasting stream passage extending at least partly through the length of the body and having an input end connectable to a dry ice blasting stream source and a discharge end at a distal end of the body, and a heating fluid cavity between the blasting stream passage and an outer surface of the body. The heating fluid cavity is configured to circulate a heating fluid therethrough. The heating mechanism comprises a fluid heater and pump fluidly coupled to the cavity and configured to heat and circulate a heating fluid through the cavity at a flow rate and temperature sufficient to impede condensation and frost from forming on the outer surface of the body when a dry ice blasting stream is flowing through the blasting stream passage. In particular, the heater and pump can be operated to circulate the heating fluid through the cavity at a flow rate and temperature sufficient to maintain the outer surface of the body above the ambient dew point.

The body can comprise a sufficient quantity and distribution of dielectric material to achieve the dielectric properties necessary for the wand to operate in proximity to energized extremely high voltage (EHV) equipment. In particular, the body can comprise one or more dielectric materials. Also, the body can have sufficient length to allow an operator holding the handle portion to stand a safe distance away from the energized EHV equipment while the equipment is being cleaned by the wand.

The fluid heater and pump can be separate from or integrated into the body. A handle can be attached to the handle portion of the body, or a handle can be integrally formed with the body at its handle portion end. A nozzle can be attached to the discharge end of the blasting stream passage, or integrally formed into the distal end of the body.

The cavity can be annular and surround the dry ice blasting stream passage, thereby acting as a thermal insulator between the outer surface of the body and the passage. In particular, the annular cavity can be defined as the space between a pair of concentric, spaced tubes. The inside of the inner tube serves as the blasting stream passage, and the outside of the outer tube serves as the outer surface of the body. The outer surface of the body can have a smooth finish for encouraging water to bead on the surface.

The cleaning apparatus can further comprise an annular metallic corona ring coupled to the vicinity of the distal end of the body The corona ring has a sharp peripheral edge which generates negative corona, thereby preventing positive corona from contacting the outside surface of the outer tube and causing damage.

A gimbeled fitting can be attached to the body and be connectable to a dielectric rope suspended from a support structure, to support the wand for use by an operator.

DETAILED DESCRIPTION OF EMBODIMENTS OF THE INVENTION

Figure 1:
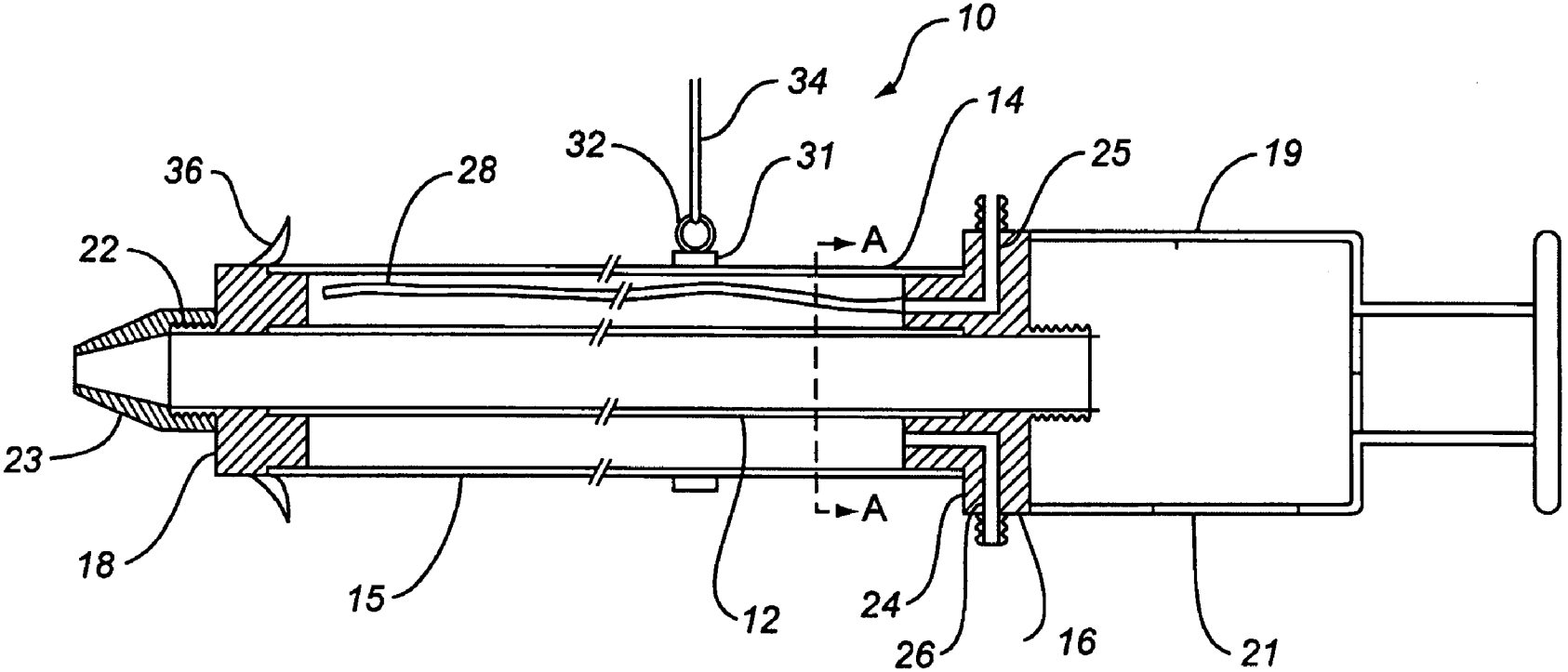
FIG. 1 is a cut-away schematic side view of one embodiment of a dry ice blasting cleaning wand for cleaning energized electrical equipment.
Figure 2:
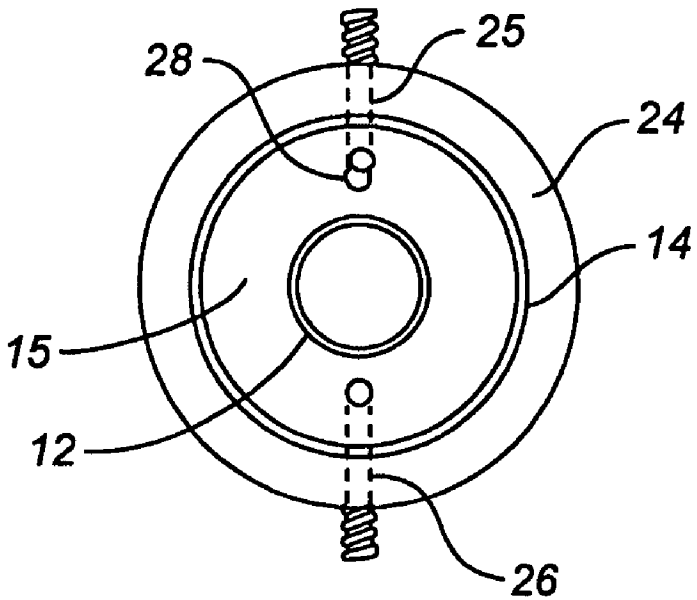
FIG. 2 is a schematic front view at section A—A in FIG. 1 of the wand.
Figure 3:
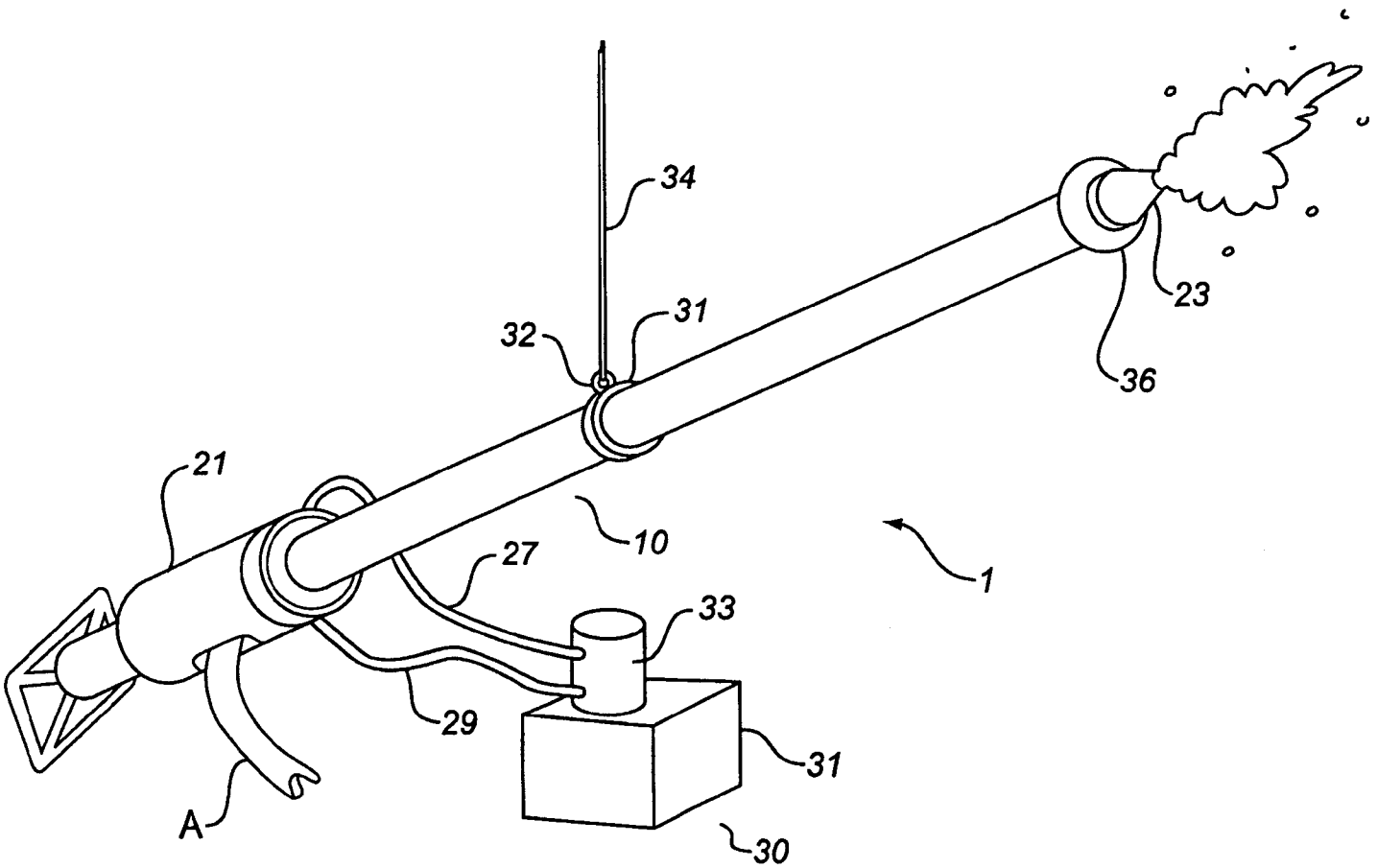
FIG. 3 is a schematic perspective view of the wand fluidly coupled to a heating fluid heater and pump.

Referring to FIGS. 1 to 3 and according to one embodiment of the invention, there is provided a dry ice blasting cleaning apparatus 1 for cleaning energized electrical equipment up to 500 kV. The apparatus 1 comprises a cleaning wand 10 with a heating mechanism that resists condensation and frost build-up on the outside of the cleaning wand 10, and thus enables the cleaning wand 10 to safely operate for a prolonged period of time without a thaw-out period. In particular, the cleaning wand 10 comprises a cylindrical inner tube 12 and a cylindrical outer tube 14 arranged concentrically around and spaced from the inner tube 12 to define an annular heating cavity 15 for receiving a heatable dielectric fluid, such as Univis J13 hydraulic oil. The inner and outer tubes 12, 14 are comprised of suitably dielectric material sufficient to achieve the dielectric properties necessary for the cleaning wand 10 to operate in proximity to energized EHV equipment for the purpose of cleaning the equipment. In addition to having dielectric properties, the inner tube 12 is made of a suitable material for withstanding the temperatures of dry ice pellets, and the pressures supplied by a dry ice blaster (not shown). Suitable materials include fibre-reinforced plastic for the outer tube 14 and dielectric-rated fibreglass for the inner tube 12. The outer tube 14 also has a smooth outer finish to promote water to bead on the tube surface.

While the tubes 12 and 14 have a circular cross-section in this embodiment, it is within the scope of the invention for the tubes to have other cross-sectional configurations, e.g. oval. The illustrated embodiment shows a cleaning wand 10 having a length that is particularly suitable for cleaning energized EHV equipment such as potheads, in the order of about thirteen feet. However, it is within the scope of the invention for the cleaning wand 10 to have different lengths, e.g. shorter lengths if the cleaning wand 10 is directed at cleaning relatively low voltage energized equipment.

The tubes 12, 14 are the same length and are capped at each end by an input end cap 16 and an output end cap 18. The caps 16, 18 close the annular cavity 15 and are sealed against the inner tube 12 by O-rings (not shown) fitted along the length of the tube. Both end caps 16, 18 are ported through their centre axes and have threaded fittings extending outwards from each port. A threaded fitting 22 on the output end cap 18 enables the output end cap 18 to attach to various nozzles 23 of different configurations. Alternatively, the nozzle 23 can be integrally formed into the output end cap 18. A threaded fitting 20 on the input cap 16 enables the input end cap 16 to attach to a flexible blasting stream feed tube (shown as "A" in FIG. 3), which is turn is coupled to a dry ice blasting source (not shown) that can supply a pressurized dry ice blasting stream to the cleaning wand 10. A suitable dry ice blasting source comprises an air compressor, an air dryer coupled to the air compressor, and a dry ice source coupled to air dryer. For example, the air compressor can be a 110 psi unit from Atlas Copco, the dryer can be a molecular sieve dryer by Dominick Hunter Filters Limited, and the dry ice source can be a Hyper Velocity Dry Ice unit by Alpheus capable of delivering 4 lbs/min of dry ice.

The input end cap 16 has an annular shoulder 24 protruding outwards from the end cap 16. The input end cap 16 is further ported with a heating fluid feed channel 25 and a heating fluid discharge channel 26 both of which extend radially through the shoulder 24 and then axially into the annular cavity 15. The heating fluid feed channel 25 provides a fluid flow pathway from the outside of the wand 10 and into the cavity 15, i.e. has an inlet end on the shoulder 24, and an outlet end at the distal end of the input end cap 16. A delivery tube 28 is attached to the outlet end of the feed channel 25, and extends most of the length of the cavity 15, terminating just before the proximal end of the output end cap 18. Similarly, the heating fluid discharge channel 26 provides a fluid flow pathway from the cavity 15 to the outside of the wand 10, i.e. has an inlet end on the distal end of the input end cap 16 and an outlet end on the shoulder 24.

Both channels 25, 26 have threaded fittings extending radially outwards from the shoulder's surface; these threaded fittings enable a flexible heating fluid feed tube 27 to be coupled to the heating fluid feed channel 25, and a flexible heating fluid discharge tube 29 to be coupled to the heating fluid discharge channel 26. The heating fluid feed and discharge tubes 27, 29 are each respectively fluidly coupled to a supply and return port of a heating fluid source 30. The heating fluid source 30 comprises a heating fluid reservoir 31 for storing the dielectric fluid, heating elements (not shown) inside the reservoir 31 for heating the dielectric fluid to a suitable temperature, and a pump 33 for circulating heated dielectric fluid through the cavity 15. A suitable such heating fluid source comprises a ½ hp pump and a 1500 watt electrically powered heater with electronic controller.

A handle 19 (shown in FIG. 3) is attached at its distal end to the shoulder 24 and provides an operator a means for gripping and operating the wand 10. The handle 19 is made of a PVC plastic with suitable dielectric properties. The handle 19 is generally a elongated hollow cylinder with a gripping portion at its proximal end; an opening 21 in the handle permits the dry ice blasting tube A to extend therethrough and connect with the input end cap 16.

While the handle is shown in FIG. 1 as a separate part that is attached to the shoulder 24, the handle 19 can alternatively be integrally formed into the input end cap 16.

The wand 10 is designed for single person operation. An operator grasps the wand 10 at the proximal end of the handle 19 and points the nozzle 23 towards the equipment to be cleaned. The wand 10 tends to be heavy and awkward to hold, especially when built at lengths suitable to clean energized EHV equipment. Therefore, the wand 10 can be suspended from a support structure such as a crane (not shown), such that the operator does not have to carry the wand 10 and can merely aim the wand 10 at the equipment to be cleaned. A support ring 31 surrounds the outer tube 14 at around the centre of gravity of the wand 10 and has a gimbel ring 32 attached thereto. A rope 34 made of suitable dielectric is material is fastened at one end to the gimbel ring 32 and at its other end to the crane or other support device.

A metallic corona ring 36 is fitted around the output end cap 18 for the purpose of preventing positive corona from impinging on the material comprising the outer tube 14. Corona discharges are electric arcs through air ionized by an electric field and disturbed by a metallic object in the electric field. The arcs terminate at interfaces between materials of differing dielectric properties; when such materials comprise the distal end of the cleaning wand 10, the electric arc can cause high stresses and possibly damage to the fibreglass outer tube 14, degrading the mechanical integrity of the tube and reducing the operating life of the cleaning wand 10. The corona ring 36 has a sharp circumferential outer edge which serves to collect a corona arc, which is distributed around the entire circumference of the ring, thereby avoiding the high stresses experienced at localized point sources contacted by the corona arc.

In operation, the cleaning wand 10 is elevated into a suitable position by a crane, i.e. to an elevation comfortable for use by the operator and at a suitable safe distance from the equipment to be cleaned. The dry ice blasting source is activated, wherein $CO_2$ ice pellets are mixed with a dried air stream to create the dry ice blasting stream. The dry ice blasting source is then operated to propel the dry ice stream under pressure through the feed tube A, through the hollow handle 19, through the inner tube 12 and finally out of the nozzle 23. As the cleaning wand 10 is supported by the rope 34 on the gimbel 32, the operator can easily manipulate the direction of the blasting stream when cleaning the electrical equipment.

The fluid heater 30 is also activated to heat up the dielectric fluid and to pump the dielectric fluid through the cavity 15. The heated dielectric fluid is pumped from the heating fluid source 30, through the heating fluid feed tube 27, through the heating fluid feed channel 25 and out of the delivery tube 28. The heated dielectric fluid is discharged into the cavity 15 near the output end cap 18, and flows through the length of the cavity 15 towards the input end cap 16, then out of the cavity 15 through the discharge port 26 and back to the heating fluid source 30 via the heating fluid discharge tube 29, where the dielectric fluid is reheated and pumped back into the cavity 15. The fluid flow rate and temperature are controlled by the heating fluid source 30 so that as the dielectric fluid flows through the cavity 15, the dielectric fluid delivers sufficient heat to the outer tube 14 to maintain the temperature of the outside surface of the outer tube 14 above ambient dew point and hence prevent condensation of potentially hazardous water on the outer tube 14. The return temperature of the fluid is monitored to ensure it remains above the ambient dew point; and the fluid's temperature is adjusted accordingly.

The invention is not to be limited by the embodiment shown in the drawings and described in the description, which is given by way of example and not limitation, but only in accordance with the scope of the appended claims.

What is claimed is:

1. A dry ice blasting cleaning apparatus comprising (a) a cleaning wand comprising (i) an elongated body having a handle portion at a proximal end of the body;

(ii) a dry ice blasting stream passage extending at least partly through the length of the body and having an input end connectable to a dry ice blasting stream source and a discharge end at a distal end of the body, and (iii) a heating fluid cavity between the blasting stream passage and an outer surface of the body, the heating fluid cavity configured to circulate a heating fluid therethrough; and (b) a fluid heater and pump fluidly coupled to the cavity and configured to heat and circulate a heating fluid through the cavity at a flow rate and temperature sufficient to impede condensation and frost from forming on the outer surface of the body when a dry ice blasting stream is flowing through the blasting stream passage.

2. A cleaning apparatus as claimed in claim 1 wherein the body comprises a sufficient quantity and distribution of dielectric material to achieve the dielectric properties necessary for the wand to operate in proximity to energized extremely high voltage (EHV) equipment.

3. The cleaning apparatus as claimed in claim 2 wherein the body comprises one or more dielectric materials.

4. A cleaning apparatus as claimed in claim 2 wherein the body has sufficient length to allow an operator holding the handle portion to stand a safe distance away from the energized EHV equipment while the equipment is being cleaned by the wand.

5. A cleaning apparatus as claimed in claim 1 wherein the cavity is annular and surrounds the dry ice blasting stream passage.

6. A cleaning apparatus as claimed in claim 1 further comprising an annular metallic corona ring coupled to the vicinity of the distal end of the body, the corona ring having a sharp peripheral edge for dissipating a corona arc.

7. A cleaning apparatus as claimed in claim 1 wherein the outer surface of the body has a smooth finish for encouraging water to bead on the surface.

8. A cleaning apparatus as claimed in claim 1 further comprising a gimbeled fitting attached to the body and connectable to a dielectric rope suspended from a support structure.

9. A cleaning apparatus as claimed in claim 1 wherein the heater and pump are operated to circulate the heating fluid through the cavity at a flow rate and temperature sufficient to maintain the outer surface of the body above the ambient dew point.

10. A dry ice blasting cleaning wand comprising (a) an elongated body having a handle portion at a proximal end of the body;

(b) a dry ice blasting stream passage extending at least partly through the length of the body and having an input end connectable to a dry ice blasting stream source and a discharge end at a distal end of the body; and (c) a heating fluid cavity between the blasting stream passage and an outer surface of the body, the heating fluid cavity configured to circulate a heating fluid therethrough at a flow rate and temperature sufficient to impede condensation and frost from forming on the outer surface of the body when a dry ice blasting stream is flowing through the blasting stream passage.

11. A cleaning wand as claimed in claim 10 wherein the body comprises a sufficient quantity and distribution of dielectric material to achieve the dielectric properties necessary for the wand to operate in proximity to energized extremely high voltage (EHV) equipment.

12. The cleaning wand as claimed in claim 11 wherein the body comprises one or more dielectric materials selected from the group of fibre-reinforced plastic, PVC plastic, and fibreglass.

13. A cleaning wand as claimed in claim 11 wherein the body has sufficient length to allow an operator holding the handle portion to stand a safe distance away from the energrized equipment while the equipment is being cleaned by the wand.

14. A cleaning wand as claimed in claim 10 wherein the cavity is annular and surrounds the dry ice blasting stream passage.

15. A cleaning wand as claimed in claim 10 further comprising an annular metallic corona ring coupled to the vicinity of the distal end of the body, the corona ring having a sharp peripheral edge for dissipating a corona arc.

16. A cleaning wand as claimed in claim 10 wherein the outer surface of the body has a smooth finish for encouraging water to bead on the surface.

17. A cleaning wand as claimed in claim 10 further comprising a gimbeled fitting attached to the body and connectable to a dielectric rope suspended from a support structure.

* * * * *